US008806902B2

(12) United States Patent
Henssen

(10) Patent No.: US 8,806,902 B2
(45) Date of Patent: Aug. 19, 2014

(54) CUT RESISTANT COMPOSITE YARN

(75) Inventor: Giovanni Joseph Ida Henssen, Born (NL)

(73) Assignee: DSM IP Assets B.V., Heerlen (NL)

( * ) Notice: Subject to any disclaimer, the term of this patent is extended or adjusted under 35 U.S.C. 154(b) by 0 days.

(21) Appl. No.: 13/148,363

(22) PCT Filed: Feb. 9, 2010

(86) PCT No.: PCT/EP2010/051561

§ 371 (c)(1),
(2), (4) Date: Nov. 3, 2011

(87) PCT Pub. No.: WO2010/089410

PCT Pub. Date: Aug. 12, 2010

(65) Prior Publication Data

US 2012/0060563 A1 Mar. 15, 2012

(30) Foreign Application Priority Data

Feb. 9, 2009 (EP) ..... 09001759

(51) Int. Cl.

| | |
|---|---|
| ***D04B 1/18*** | (2006.01) |
| ***D02G 3/32*** | (2006.01) |
| ***D02G 3/44*** | (2006.01) |
| *A41D 19/015* | (2006.01) |

(52) U.S. Cl.

CPC ..... *D02G 3/442* (2013.01); *A41D 19/01505* (2013.01); *D02G 3/32* (2013.01)

USPC ..... 66/174; 57/225

(58) Field of Classification Search

USPC ..... 66/170, 171, 174, 202; 2/16, 161.6, 2/167; 57/210, 211, 224, 225, 230, 231

See application file for complete search history.

(56) References Cited

U.S. PATENT DOCUMENTS

| | | | | |
|---|---|---|---|---|
| 5,287,690 | A * | 2/1994 | Toon | 57/210 |
| 6,581,366 | B1 | 6/2003 | Andrews | |
| 7,413,802 | B2 * | 8/2008 | Karayianni et al. | 428/370 |
| 7,504,127 | B2 * | 3/2009 | Karayianni et al. | 427/118 |
| 7,665,288 | B2 * | 2/2010 | Karayianni et al. | 57/3 |
| 7,765,835 | B2 * | 8/2010 | Karayianni et al. | 66/172 E |
| 7,926,254 | B2 * | 4/2011 | Karayianni et al. | 57/310 |
| 7,946,102 | B2 * | 5/2011 | Karayianni et al. | 57/225 |
| 2002/0041958 | A1 | 4/2002 | Andrews | |
| 2004/0205946 | A1 | 10/2004 | Zhu | |
| 2004/0254286 | A1 | 12/2004 | Hansen et al. | |
| 2008/0145301 | A1 * | 6/2008 | Van Der Werff et al. | 423/447.2 |

FOREIGN PATENT DOCUMENTS

| | | | |
|---|---|---|---|
| JP | 2001-303324 | A2 | 10/2001 |
| JP | 2003-201607 | A2 | 7/2003 |
| WO | WO 2006/010521 | | 2/2006 |
| WO | WO 2008/046476 | | 4/2008 |

OTHER PUBLICATIONS

International Search Report for PCT/EP2010/051561, mailed Mar. 16, 2010.

* cited by examiner

*Primary Examiner* — Danny Worrell
(74) *Attorney, Agent, or Firm* — Nixon & Vanderhye P.C.

(57) ABSTRACT

The invention relates to a cut resistant composite yarn comprising: a) at least one yarn containing filaments and/or staple fibers, said filaments and/or staple fibers containing a hard component, said hard component being a plurality of hard fibers, said hard fibers having an average diameter of at most (25) microns; and b) at least one continuous elastic filament. The invention further relates to a fabric and articles comprising the yarn, in particular a glove.

15 Claims, No Drawings

CUT RESISTANT COMPOSITE YARN

This application is the U.S. national phase of International Application No. PCT/EP2010/051561 filed 9 Feb. 2010 which designated the U.S. and claims priority to EP Patent Application No. 09001759.1 filed 9 Feb. 2009, the entire contents of each of which are hereby incorporated by reference.

The invention relates to a cut resistant composite yarn and to products comprising said composite yarn. In particular the invention relates to a cut resistant fabric and glove comprising said composite yarn.

WO 2008/046476 discloses a cut resistant yarn comprising filaments and/or staple fibers, said filaments or fibers comprising a hard component in the form of a plurality of hard fibers having an average diameter of at most 25 micron. A process to produce the yarn is also disclosed therein. A yarn according to WO 2008/046476 is easy to manufacture and shows improved cut resistance, good mechanical properties and is flexible and easy to clean. WO 2008/046476 also discloses a composite yarn comprising the cut resistant yarn described above twisted around a core consisting of a metal wire.

It is the object of the present invention to offer a cut resistant composite yarn having improved mechanical and cut resistant properties. It is a further object of the invention to provide a lightweight fabric having improved cut resistance properties.

The invention therefore provides a cut resistant composite yarn comprising:

a) at least one first yarn containing polymeric filaments and/or staple polymeric fibers, said filaments and/or staple fibers containing a hard component, said hard component being a plurality of hard fibers, said hard fibers having an average diameter of at most 25 microns; and b) at least one continuous elastic filament.

It was observed that wearing an article manufactured from the yarn of the invention, in particular a glove, is less fatiguing and furthermore, said article provides an improved cut resistance compared with articles manufactured from yarns consisting of only the first yarn or of composite yarns containing steel or glass fibers.

In order to reach the same cut resistance level, composite yarns comprising steel or glass fibers are usually employed. These fibers, especially the glass fibers, break during intense or prolonged use causing skin irritation.

It was observed that articles comprising the yarn of the invention cause a reduced skin irritation even after prolonged and/or intense utilization.

It was also observed that articles manufactured from the yarn of the invention show a reduced weight for the same level of cut resistance.

Illustrative examples of materials for the manufacturing of the polymeric filaments and staple polymeric fibers of the first yarn include but are not limited to for example polyamides and polyaramides, e.g. poly(p-phenylene terephthalamide) (e.g. Kevlar®), poly(metaphenylene isophthalamide) (e.g. Nomex®), poly(m-xylylene adipamide), poly(p-xylylene sebacamide), poly(2,2,2-trimethyl-hexamethylene terephthalamide), poly(piperazine sebacamide), and aliphatic and cycloaliphatic polyamides, e.g the copolyamide of 30% hexamethylene diammonium isophthalate and 70% hexamethylene diammonium adipate, the copolyamide of up to 30% bis-(-amidocyclohexyl)methylene, terephthalic acid and caprolactam; poly(tetrafluoroethylene) (PTFE); poly{2,6-diimidazo-[4,5b-4',5'e]pyridinylene-1,4(2,5-dihydroxy)phenylene} (known as M5); poly(p-phenylene-2,6-benzobisoxazole) (P80) (known as Zylon®); polyvinyl alcohols; but also polyolefins e.g. homopolymers and copolymers of polyethylene and/or polypropylene.

A preferred material for manufacturing the polymeric filaments and/or staple polymeric fibers of the first yarn is polyolefin, in particular polyethylene, more preferably ultrahigh molecular weight polyethylene (UHMwPE), i.e. a polyethylene having an intrinsic viscosity (IV) of at least 8 dl/g, as determined according to method FTC-179 (Hercules Inc. Rev. Apr. 29, 1982) at 135° C. in decalin, with dissolution time of 16 hours, with anti-oxidant DBPC in an amount of 2 g/l solution, and the viscosity at different concentrations extrapolated to zero concentration.

The first yarn is preferably manufactured according to the process described in WO 2008/046476, incorporated herein by reference.

The hard component in the first yarn is a plurality of fibers produced out of a hard material. Hard in the context of the invention means at least harder than the filaments or staple fibers itself without the hard fibers. Preferably the material that is used to produce the fibers has a MOHS hardness of at least 2.5, more preferably at least 4, most preferably at least 6. Good examples of suitable hard fibers include, glass fibers, mineral fibers or metal fibers The titer of the filaments and/or the staple fibers of the first yarn is preferably at least 0.1 dpf, more preferably at least 1.0 dpf, most preferably at least 1.5 dpf. The advantage thereof is that a fabric comprising lower dpf fibers has an improved comfort. Preferably said titer is at most 20 dpf, more preferably at most 10 dpf, most preferably at most 5 dpf. Good results are obtained when the titer of the first yarn is at least 10 dtex, preferably at least 40 dtex, more preferably at least 70 dtex. The maximum titer of the first yarn is dictated only by practical reasons and is preferably at most 7500 dtex, more preferably at most 5000 dtex, most preferably at most 2500 dtex. In a preferred embodiment, the titer of the first yarn is between 100 and 400 dtex, more preferably between 200 and 300 dtex, the advantage being that a yarn of the invention containing thereof can be suitable used to construct articles, e.g. gloves, that are lighter and/or have an improved cut resistance.

The titer of the yarn of the invention is preferably between 100 dtex and 10000 dtex, more preferably between 200 dtex and 1000 dtex, most preferably between 300 dtex and 500 dtex. It was observed that yarns of the invention having such a low titer can be used to construct articles, e.g. gloves, with an improved cut resistance. For example a glove comprising a fabric constructed from yarns of the invention which have a titer between 300 dtex and 500 dtex is not only thin and lightweight but provides the wearer with increased dexterity when handling small objects while having a good cut resistance.

The yarn of the invention also contains at least one elastic filament, i.e. a filament having stretch and recovery. The elastic filament can also be covered with other types of filaments and/or staple fibers forming a sheath around said elastic filament, although it is not critical that the elastic filament (s) actually be fully covered by said sheath.

The elastic filament in the yarn of the invention can be present in the form of one or more individual filaments or one or more coalesced grouping of filaments. However, it is preferred to use only one coalesced grouping of filaments. Whether present as one or more individual filaments or one or more coalesced groupings of filaments the overall linear density of the elastic filament(s) in the relaxed state is preferably between 8 and 560 dtex with a preferred linear density range between 17 and 560 dtex, more preferably between 22 and 220 dtex, even more preferarbly between 40 and 220 dtex, even between 44 and 220 dtex most preferably between 44 and 156 dtex. It was observed that an article of the invention comprising elastic filaments with a titer within the preferred ranges, the cut resistance of said article was improved.

Preferred elastic fibers include olefin-based stretch fibers, e.g. DOW XLA; bi-component polyester based fibers, e.g. T400 from DuPont; and texturized polyesters or nylons. Texturizing is a process whereby partially oriented filament yarns of polyester or nylon are stabilized through heating and drawing to produce crimped and elastic continuous filament yarns.

A more preferred elastic fiber is a fiber manufactured from a long chain synthetic polymer comprising a segmented polyurethane. Preferably, said polymer comprises at least 85% by weight of segmented polyurethane. More preferably, the segmented polyurethanes are of spandex type. Among the segmented polyurethanes of the spandex type are those described in, for example, U.S. Pat. Nos. 2,929,801; 2,929,802; 2,929,803; 2,929,804; 2,953,839; 2,957,852; 2,962,470; 2,999,839; and 3,009,901.

The yarn of the invention may also contain other filaments and/or staple fibers, e.g. filaments and/or staple fibers manufactured from the polymeric materials exemplified in the illustrative examples mentioned above without the hard component. Such filaments and/or staple fibers are commercially available. Staple fibers are commonly obtained by cutting or stretch-breaking filaments.

Preferably, the yarn of the invention further comprises at least one yarn containing filaments and/or staple fibers of polyester, e.g. polyethylene terephthalate), poly(butylene terephthalate), and poly(1,4 cyclohexylidene dimethylene terephthalate). It was observed that a fabric manufactured from such a yarn shows a good dyebility and further improved cut resistance.

Preferably, the yarn of the invention further comprises at least one yarn containing filaments and/or staple fibers of nylon, e.g. poly(hexamethyleneadipamide) (known as nylon 6,6), poly(4-aminobutyric acid) (known as nylon 6). It was observed that a fabric manufactured from such a yarn shows also good dyebility and improved cut resistance. Preferably, the titer of said yarn containing filaments and/or staple fibers of nylon is at least 10 dtex, more preferably at least 50 dtex, most preferably at least 100 dtex. The maximum titer of said yarn containing filaments and/or staple fibers of nylon is only limited by practicalities, preferably said titer is at most 10.000 dtex, more preferably at most 5000 dtex, most preferably at most 1000 dtex.

Preferably, the yarn of the invention further comprises at least one yarn containing melt spun filaments and/or staple fibers of polyethylene. It was observed that a fabric manufactured from such a yarn shows an improved comfort.

Preferably, the yarn of the invention further comprises at least one yarn containing gel spun filaments and/or staple fibers of UHMwPE, e.g. UHMwPE yarns known as Dyneema®. It was observed that a fabric manufactured from such a yarn shows a further improved cut resistance.

The above preferred yarns may also be combined and used in the yarn of the invention.

The first yarn and the elastic filament of the yarn of the invention may be twisted together as it was observed that a twisted yarn has an improved mechanical stability. Improved abrasion resistance and comfort are obtained when the twist (in turns/meter) is between 50 and 500, more preferably between 150 and 400.

In a more preferred embodiment, the yarn of the invention is constructed by keeping the elastic filament under tension while wrapping the first yarn around said elastic filament. Preferably, a second yarn, e.g. a polyester yarn, is wrapped around the first yarn to form a double wrapping construction.

The invention further relates to a fabric comprising the yarn of the invention.

The fabric of the invention may be of any construction known in the art, e.g. woven, knitted, plaited, braided or non-woven or combinations thereof. Woven fabrics may include plain weave, rib, matt weave and twill weave fabrics and the like. Knitted fabrics may be weft knitted, e.g. single- or double-jersey fabric or warp knitted. An example of a non-woven fabric is a felt fabric. Further examples of woven, knitted or non-woven fabrics as well as the manufacturing methods thereof are described in "*Handbook of Technical Textiles*", ISBN 978-1-59124-651-0 at chapters 4, 5 and 6, the disclosure thereof being incorporated herein as reference. A description and examples of braided fabrics are described in the same Handbook at Chapter 11, more in particular in paragraph 11.4.1, the disclosure thereof being incorporated herein by reference.

Preferably the inventive fabric is a knitted or a woven fabric. Good results were obtained with circular or warp knit fabrics, flat knit or a plain weave fabric. It was observed that such fabrics show an increased degree of flexibility and softness while having an improved cut resistance. A flat knit proved to be particularly advantageous when used to construct gloves.

It was impossible hitherto to utilize knitting machines having a gauge as high as 18 and above to manufacture fabrics from polymeric yarns, i.e. yarns free of glass or steel fibers, and having a high level of cut resistance. In such high gauge machines only yarns having low titer, e.g. below 400 dtex, can be used. However, by using a low titer yarn the cut resistance of the obtained fabric also decreases. Hence, knitting machines having a gauge of at most 13 were used hitherto to manufacture fabrics having cut resistant properties.

It was observed that with the yarn of the invention, fabrics having a high level of cut resistance, i.e. cut resistance above 500 g as measured by ASTM F 1790-97, which are also lightweight, i.e. having an areal density of below 400 g/m$^2$, can be produced. Fabrics with such a high cut resistance can be manufactured from the yarn of the invention with a commonly used e.g. 15 or 18 gauge knitting machine.

The invention therefore relates to a lightweight, cut resistant fabric having a cut resistance as measured by ASTM F 1790-97 above 500 g and an areal density of at most 400 g/m$^2$. More in particular, the invention relates to a lightweight, cut resistant fabric having a cut resistance as measured by ASTM F 1790-97 above 500 g and an areal density of at most 400 g/m$^2$ said fabric containing the yarn of the invention. Areal density is the weight of the fabric per unit area expressed in grams per m$^2$. Preferably, the cut resistance of the lightweight, cut resistant fabric is at least 1000 g, more preferably at least 1500 g, most preferably at least 2000 g. Preferably, the areal density of the lightweight, cut resistant fabric is at most 300 g/m$^2$, more preferably at most 200 g/m$^2$. Preferably the lightweight, cut resistant fabric of the invention is a knitted fabric, more preferably is a fabric knitted on a knitting machine having a gauge of at least 15, more preferably of 18 or higher. Preferably, the lightweight, cut resistant fabric of the invention comprises the yarn of the invention. The invention also relates to a glove comprising the lightweight, cut resistant fabric of the invention.

The invention further relates to a glove comprising the yarn of the invention. Such a glove presents improved comfort and dexterity. Furthermore, the glove of the invention reduces the finger fatigue of the wearer especially during prolonged utilization.

The fabric and in particular the glove of the invention are preferably coated at least over a part of their surface with an elastomeric coating. Preferably, said coating is obtained from an aqueous dispersion of said elastomer or from a solution of said elastomer in a suitable solvent. Preferably, the elastomer is based on materials selected from the group consisting of polyurethanes (water or solvent based), polyethylene chlorosulphone (e.g. HYPALON®), polyvinyl alcohols, butylic rubbers, nitrile and mixtures thereof. A coating method is for example disclosed in EP 1.349.463. The most preferred elastomer is polyurethane for its good friction properties.

The invention also relates to other articles, in particular clothing, as for example outerwear, garments, raiment and the like comprising the inventive fabric.

Examples of clothing articles include but are not limited to aprons, chaps, pants, shirts, jackets, coats, socks, undergarments, vests, hats and the like.

Particular apparels where the inventive fabric is advantageously used include sports related apparel, e.g. protective clothing for skaters, motorcyclists. cyclists, but also skiwear, head bands, and liners for helmets.

The invention also relates to the use of the inventive fabric in the above articles and in particular in the examples mentioned hereinabove.

COMPARATIVE EXPERIMENTS AND EXAMPLES

Comparative Experiment 1

A yarn was constructed from:

i. a 440 dtex standard gel spun filament UHMwPE yarn known under the name Dyneema® SK65;

ii. a 78 dtex (46 filaments) spun-dyed black polyamide.

iii. a 110 dtex Lycra® yarn.

The Lycra® yarn was elongated (drafted) on a double covering machine, wrapped first with the Dyneema® yarn and then double wrapped a second time with the Nylon yarn.

The above yarn was knitted on a Shima Seiki 13 gauge glove knitting machine to result in a glove. The glove was dipped in polyurethane (solvent based). The cut performance of the glove according to ASTM F 1790-97 was 450 g.

Comparative Experiment 2

A yarn was constructed with the above mentioned yarns in accordance with the Comparative Experiment 1 (see i.-iii. above). The titer of the Dyneema® SK65 was 220 dtex, the titer of the Lycra® yarn was about 36 dtex and the titer of the spun-dyed black polyamide was about 65 dtex. The Lycra® yarn was elongated (drafted) two times on a double covering machine and wrapped first (S wrapping) with the Dyneema® yarn with 200 turns/meter and then wrapped a second time (Z wrapping) with the Nylon yarn with 250 turns/meter.

The yarn was used in an 18 gauge knitting machine to construct a glove containing a fabric in a single jersey configuration. The weight of the glove was about 15 g. The palm of the glove was covered with polyurethane by dipping said glove in a water based polyurethane dispersion. The weight of the coated glove was about 19 g. The cut resistance measured in accordance with ASTM F 1790-97 was 250 g.

Example 1

A yarn was constructed as in the comparative experiment 1 with the following components:

i. a 440 dtex yarn consisting of 5 wt % mineral fibers (sold under the trade name RB215-Roxul™ 1000) and 95 wt. % of UHMWPE (IV of about 21.0 dl/g) manufactured according to Example 1 of WO 2008/046476;

ii. the 78 dtex spun-dyed black polyamide.

iii. the 110 dtex Lycra® yarn.

The cut resistance of a glove manufactured according to the comparative experiment was 1601 g, more than 3.5 times higher than the glove of the comparative experiment.

Example 2

A yarn was constructed as in the comparative experiment 1 with the following components:

i. a 440 dtex yarn consisting of 5 wt % mineral fibers (sold under the trade name RB215-Roxul™ 1000) and 95 wt. % of UHMWPE (IV of about 21.0 dl/g) manufactured according to Example 1 of WO 2008/046476;

ii. a 156 dtex spun-dyed black polyamide.

iii. the 110 dtex Lycra® yarn.

The cut resistance of a glove manufactured according to the comparative experiment was 1789 g, more than 3.9 times higher than the glove of the comparative experiment.

Example 3

Comparative experiment 2 was repeated however the 220 dtex Dyneema® SK65 was replaced with a 220 dtex yarn consisting of 5 wt % mineral fibers (sold under the trade name RB215-Roxul™ 1000) and 95 wt. % of UHMWPE (IV of about 21.0 dl/g) manufactured according to Example 1 of WO 2008/046476. The weight of the glove before coating was 12.6 g and after coating was 21 g. The cut resistance of the glove was 780 g.

It was noted based on the data of the above examples and comparative experiments that the yarns of the invention provide a glove manufacture therefrom with increased cut resistance. it was also possible to use an 18 gauge knitting machine to construct said gloves which were thinner, lighter and provided the wearer with increased dexterity in handling small objects than gloves manufactured from known cut resistant yarns on 13 gauge knitting machines.

The invention claimed is:

1. A cut resistant composite yarn comprising:

(a) at least one continuous elastic filament; and (b) at least one first yarn wrapped around the at least one continuous elastic filament, wherein the at least one first yarn comprises polymeric filaments and/or staple polymeric fibers and a hard component, wherein the hard component of the at least one first yarn consists of a plurality of hard fibers selected from the group consisting of glass fibers, mineral fibers and metal fibers having an average diameter of at most 25 microns; and wherein the cut resistant composite yarn has a titer of between 100 and 1000 dtex.

2. The yarn of claim 1 further comprising at least one yarn containing filaments and/or staple fibers of polyester and/or nylon.

3. The yarn of claim 1 further comprising at least one yarn containing melt spun filaments and/or staple fibers of polyethylene.

4. The yarn of claim 1 further comprising at least one yarn containing gel spun filaments and/or staple fibers of ultrahigh molecular weight polyethylene.

5. The yarn of claim 1 wherein the first yarn has a titer of between 100 and 400 dtex.

6. The yarn of claim 1 wherein the elastic filament has in the relaxed state a linear density between 8 and 220 dtex.

7. The yarn of claim 1 wherein the elastic filament is manufactured from a long chain synthetic polymer comprising segmented polyurethane.

8. The yarn of claim 1 having a titer of between 200 and 500 dtex.

9. A lightweight, cut resistant fabric comprising the yarn of claim 1.

10. The fabric of claim 9, said fabric having a cut resistance as measured by ASTM F 1790-97 above 500 g and an areal density of at most 400 $g/m^2$.

11. The fabric of claim 9 wherein said fabric is manufactured on an at least 15 gauge knitting machine.

12. The fabric of claim 11 where the knitting machine was at least 18 gauge.

13. A glove comprising the fabric of claim 9.

14. The glove of claim 13, the surface of which being at least partially coated with a polyurethane based elastomer.

15. The yarn of claim 1 further comprising at least one yarn comprising filaments and/or staple fibers formed of a thermoplastic material in the absence of hard fibers.

* * * * *